US009775473B2

(12) United States Patent
Del Rosario

(10) Patent No.: US 9,775,473 B2
(45) **Date of Patent: *Oct. 3, 2017**

(54) ILLUMINATING BAR OF SOAP

(71) Applicant: VIDA LUMINATIONS, INC., Glendale, CA (US)

(72) Inventor: Lee Del Rosario, Glendale, CA (US)

(73) Assignee: Vida Luminations, Inc., Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/144,566

(22) Filed: May 2, 2016

(65) Prior Publication Data

US 2016/0242601 A1 Aug. 25, 2016

Related U.S. Application Data

(63) Continuation-in-part of application No. 14/573,421, filed on Dec. 17, 2014, now Pat. No. 9,328,912, which is a continuation-in-part of application No. 14/323,815, filed on Jul. 3, 2014, now abandoned.

(60) Provisional application No. 61/928,272, filed on Jan. 16, 2014.

(51) Int. Cl.

| | |
|---|---|
| ***C11D 17/08*** | (2006.01) |
| ***A47K 5/12*** | (2006.01) |
| ***F21V 33/00*** | (2006.01) |
| ***B05B 11/00*** | (2006.01) |
| ***C11D 17/04*** | (2006.01) |
| *F21V 23/04* | (2006.01) |
| *F21S 9/02* | (2006.01) |
| *F21Y 115/10* | (2016.01) |

(52) U.S. Cl.

CPC ..... *A47K 5/12* (2013.01); *A47K 5/1217* (2013.01); *B05B 11/00* (2013.01); *C11D 17/046* (2013.01); *C11D 17/08* (2013.01); *F21V 33/004* (2013.01); *F21S 9/02* (2013.01); *F21V 23/0464* (2013.01); *F21V 23/0492* (2013.01); *F21Y 2115/10* (2016.08)

(58) Field of Classification Search

None

See application file for complete search history.

(56) References Cited

U.S. PATENT DOCUMENTS 5,971,827 A * 10/1999 Lee ..... A63H 5/00 446/175

2009/0166378 A1* 7/2009 Stilley ..... B05B 1/00 222/39

* cited by examiner

*Primary Examiner* — Necholus Ogden, Jr.

(74) *Attorney, Agent, or Firm* — Buchalter

(57) ABSTRACT

An illuminating soap module includes a shell defining a cavity for holding liquid soap. The shell may include one or more openings. The one or more openings may include a dispenser, a plug, a light module, and combinations thereof. The illuminating soap module is configured to illuminate upon a triggering event.

19 Claims, 14 Drawing Sheets

ILLUMINATING BAR OF SOAP

This application claims priority as a Continuation in Part application to U.S. application Ser. No. 14/573,421, filed Dec. 17, 2014, now U.S. Pat. No. 9,328,912, which is a Continuation in Part of U.S. application Ser. No. 14/323,815 filed on Jul. 3, 2014, which claims the benefit of U.S. Provisional Application No. 61/928,272 filed on Jan. 16, 2014, each of which is incorporated in its entirety by reference herein.

BACKGROUND

Washing hands properly, especially for children, can be challenging. Children in particular have a dislike for washing or are uneducated in proper washing techniques. According to the Centers for Disease Control and Prevention and US Food and Drug Administration, a person should wash their hands from 20 to 30 seconds with soap and warm water to avoid spreading possible pathogens. Having a device that makes washing hands interesting and helpful would help lessen the spread of germs and effectively avoid the spread of sicknesses and viruses.

SUMMARY

Exemplary embodiments described herein include an illuminating dispenser for liquid soap. The soap module according to an exemplary embodiment may have a rigid shell to support the module structure. The shell may define a cavity and have a first opening. The shell may be configured in one or more parts that are removably attachable. The illuminating soap module may include a dispenser at the first opening. The dispenser may be configured to open a fluid flow path from the cavity to an exterior of the shell. In an exemplary embodiment, the dispenser includes a valve that is normally biased closed, and configured to open when pressed. The illuminating soap module may include a plug in or across the second opening. The plug may include or support a light module.

In exemplary embodiments, the shell may include a second opening. The illuminating soap dispenser may include a plug sealing engaging the second opening. The plug may provide a flexible surface for washing. The plug may also support or include the light module. The plug may also permit a sensor within the light module to detect a triggering event to turn the light module on and/or off.

BRIEF DESCRIPTION OF THE FIGURES

By way of example only, selected embodiments and aspects of a contemplated embodiment are described below. Each such description refers to a particular figure ("FIG.") which shows the described matter. Each such figure includes one or more reference numbers that identify one or more part(s) or element(s) of the contemplated embodiment.

DETAILED DESCRIPTION

Figure 1:
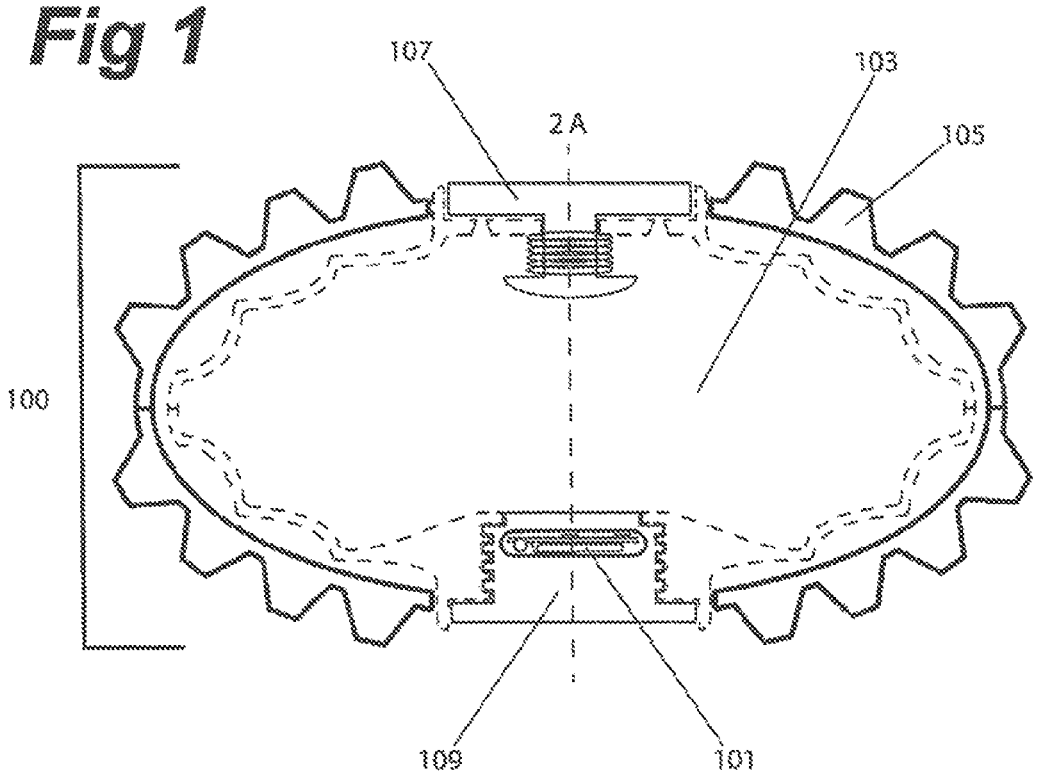
FIG. 1 illustrates a cross section of an exemplary embodiment of an illuminating soap module.

FIGS. 1-8 illustrate an exemplary embodiment of an illuminating soap module. The exemplary soap module includes a light module 101 and a shell 105 having a plug 109 and dispenser 107. FIG. 1 shows a cross-section of a contemplated embodiment of the illuminating bar of soap 100 with the light module 101 inside it.

As shown in FIG. 1, the illuminating bar of soap 100, comprises a shell 105, a soap dispenser 107 and a light module 101. The light module 101 is placed within a plug 109.

The shell 105 may be manufactured from commonly used materials such as plastic, silicon, polyvinyl chloride, rubber and the like. Other materials such as UV reactive pigments may be added to create phosphorescence to the shell 105. The shell 105 may be comprised of a single layer or multiple layers. The shell may have a smooth first layer and then a detailed second layer. The shell 105, while shown as a single layer with ridges and indentations in the contemplated embodiment, may be manufactured smooth, with bumps, with lines or other designs. The shell 105 contains a cavity 103 for soap. The cavity 103 may be used to hold liquid soap or other similar cleaning solutions. The plug 109 may be manufactured from commonly used materials such as plastic, silicon, polyvinyl chloride, rubber and the like.

Figure 2:
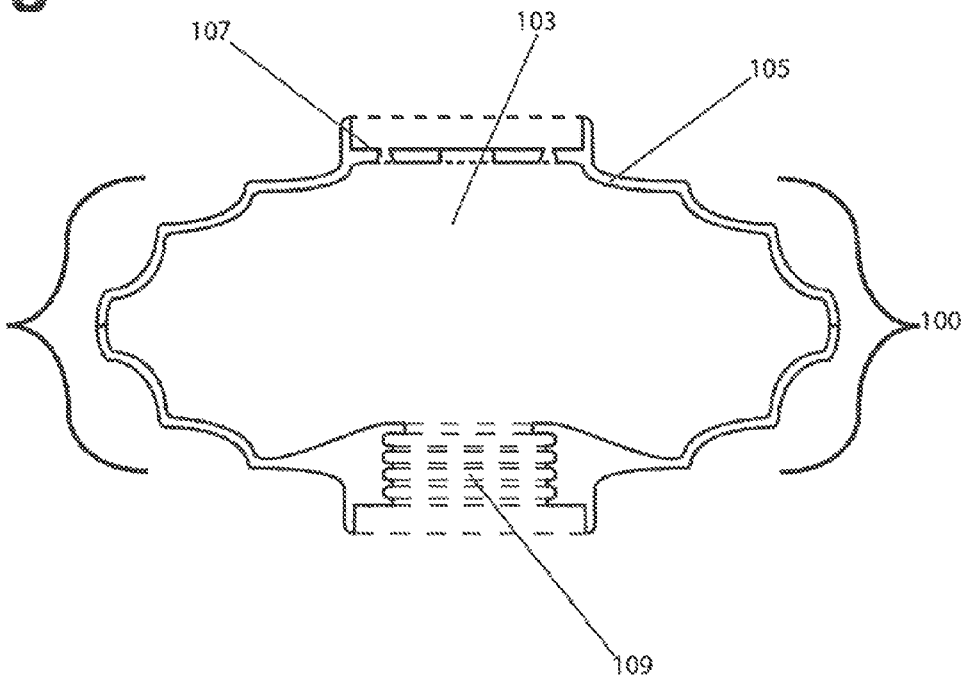
FIG. 2 illustrates a cross section through line 2A of the contemplated embodiment of the illuminating soap module.

FIG. 2 shows a cross section through line 2A of the contemplated embodiment of the illuminating bar of soap 100.

Figure 3:
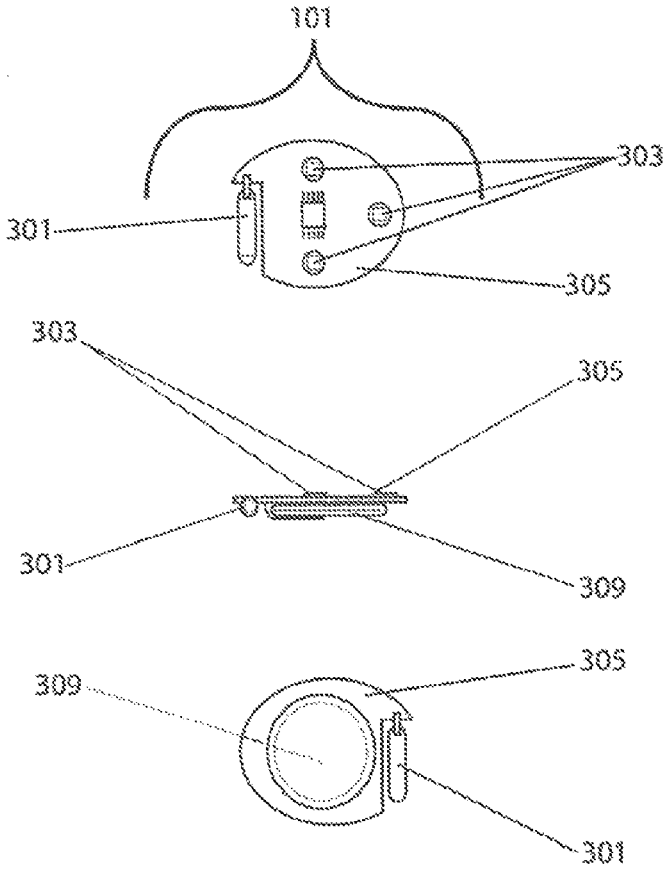
FIG. 3 illustrates an exemplary embodiment of the light module.

As shown in FIG. 3, the light module 101 comprises a sensor 301 and a light source 303. The sensor 301 and light source 303 may be constructed on a circuit board 305, it may be constructed on a circuit board with a processing unit, or be directly wired together. The sensor 301 is designed to detect a change in surroundings, a change in stability or a combination thereof and may be a motion sensor, a temperature sensor, a light sensor or any other sensor that monitors changes in surroundings. The sensor 301 triggers the light source 303.

The sensor 301, upon sensing a change, such as a change in surroundings, a change in stability or a combination thereof, triggers the light source 303 to illuminate. Should the sensor 301 be a motion sensor, upon detecting motion, the sensor triggers the light source 303 to illuminate for a predetermined length of time, usually approximately 20-30 seconds. The motion sensor may be any commonly used motion sensor such as a vibration sensor or reed switch. The light illuminates and stays illuminated for the time when the user should be lathering and rubbing their hands on the soap in order to wash their hands, often times, 20-30 seconds. When the light stops illuminating, it indicates that the user has properly washed their hands.

Should the sensor 301 be a temperature sensor, it may illuminate the light source 303 when the proper temperature for washing hands is met. Should the illumination occur at the proper temperature, the light source 303 will illuminate so long as the predetermined temperature is met. Also, it may illuminate for a predetermined length of time, so long as the predetermined temperature is met. Should the sensor 301 be a light sensor, it may illuminate the light source 303 when the sensor is exposed to light.

The light source 303 may be any commonly used light bulb including but not limited to a light emitting diode, organic light emitting diode, liquid crystal display or miniature incandescent bulb. The light source 303 may be comprised of a single light emitting diode or bulb or a plurality of them. The light source 303 may illuminate in a variety of colors, designs, patterns or shapes. The color, design, pattern or shape of the illumination may change depending on the variables from the sensor, i.e. the color may change if the temperature sensed is within a certain range. Also, the color, design, pattern or shape of the illumination may change depending on the amount of time the light source has illuminated 303 for.

The light module 101 has a battery 309 that powers it. The light module 101 is encapsulated by an inner housing 109 made of plastic, rubber or other material so that it is waterproof. The light module 101 may be encapsulated by a barrier 109 in any shape.

Figure 4:
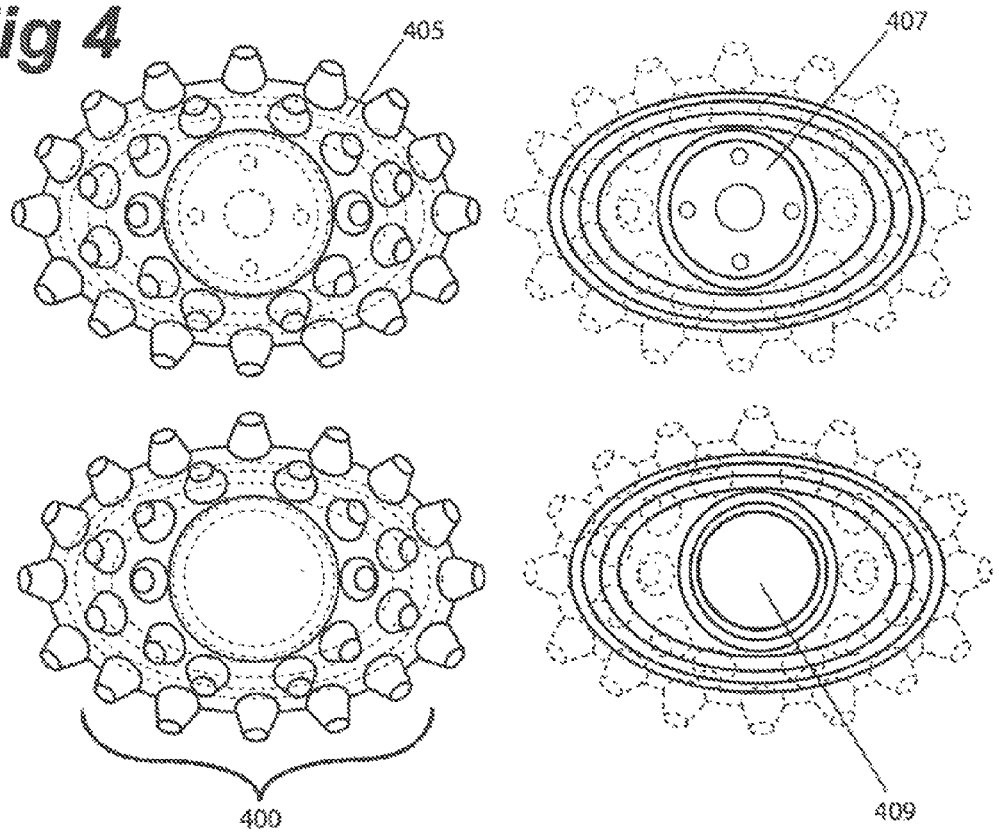
FIG. 4 illustrates an exemplary embodiment of the illuminating soap module.

FIG. 4 shows an alternative contemplated embodiment of the illuminating bar of soap 400. The shell 405 has a plug 409 and soap dispenser 407. A liquid soap is poured into the cavity 403 and is dispensed through the soap dispenser 407.

Figure 5:
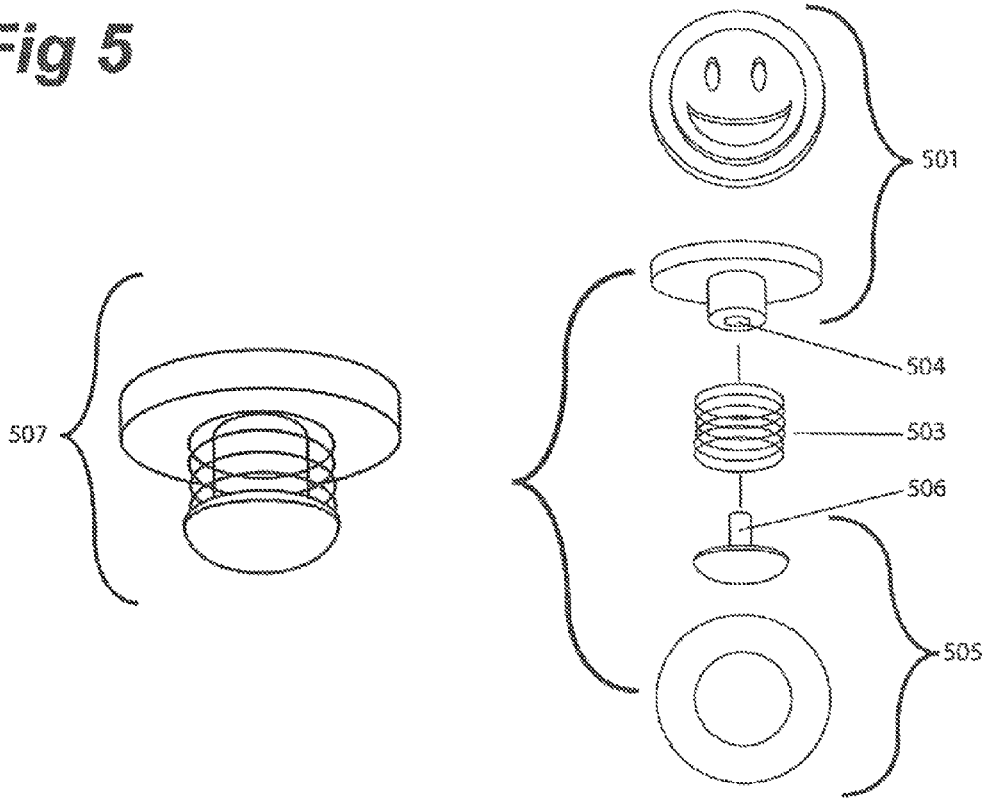
FIG. 5 illustrates an exemplary embodiment of the soap dispensing module.

FIG. 5 shows a contemplated embodiment of a soap dispenser 507. The soap dispenser 507 comprises a top button 501, a spring 503 and a bottom 505. The top button 501 contains a cylinder with a female portion 504 which accepts the protruding male portion 506 of the bottom 505. The soap dispenser when depressed compresses and releases the liquid soap. Another contemplated embodiment of a soap dispenser is a cartridge in which a top button has a protruding member that faces towards the cartridge. As the top button is depressed, it penetrates the cartridge in order to expel the soap from the cartridge. Other embodiments of dispensing liquids may be used for the soap dispenser.

Figure 6:
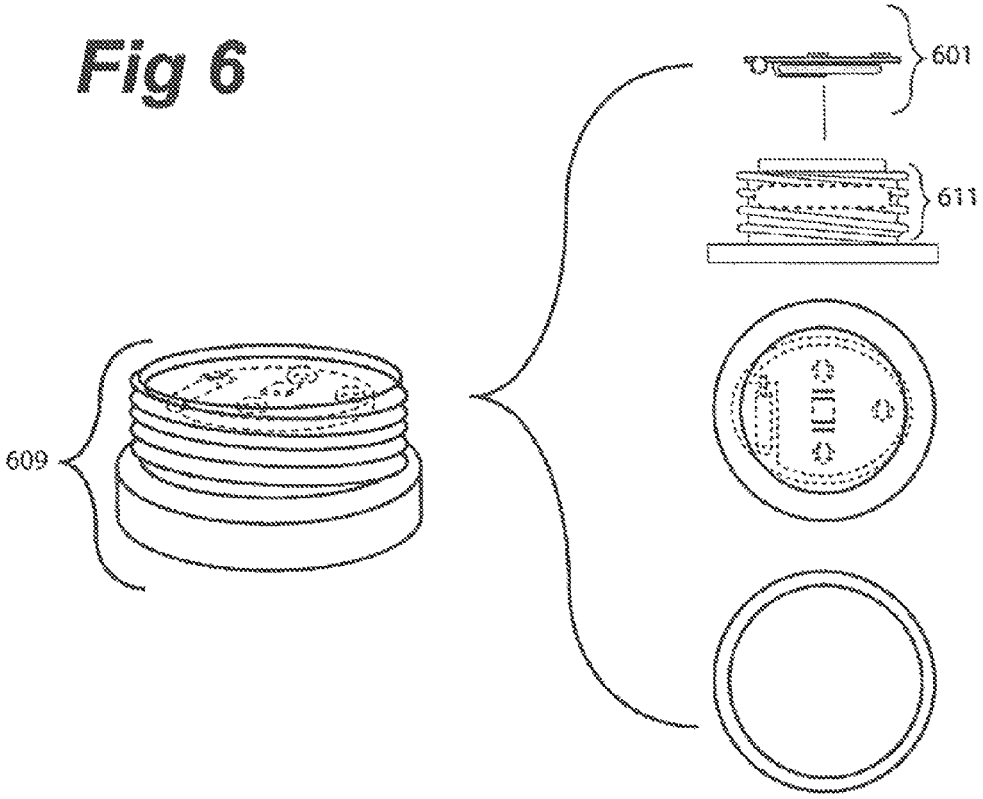
FIG. 6 illustrates an exemplary embodiment of the plug.

FIG. 6 shows a contemplated embodiment of a plug 609. The plug 609 contains a light module 601 built-in, embedded, molded, placed or located within it. The plug 609 is threaded 611 so that it may be screwed on or off of the illuminated bar of soap. The plug 609 allows soap to be poured in the cavity of the illuminated bar of soap. It plug 609 may also allow the user to change the battery in the light module 601.

Figure 7:
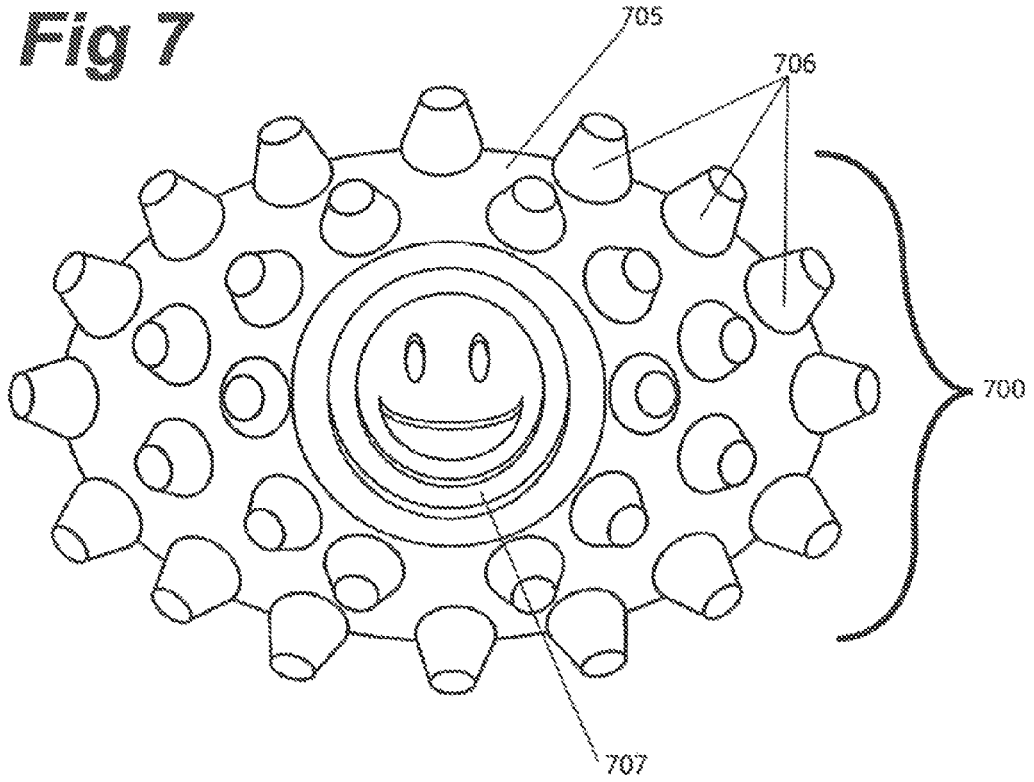
FIG. 7 illustrates an exemplary embodiment of the illuminating soap module.

FIG. 7 shows a top view of a contemplated embodiment of the illuminating bar of soap 700. The shell has a first smooth layer 705 which has an additional layer of protruding spikes 706. The soap dispenser 707 is also shown.

Figure 8:
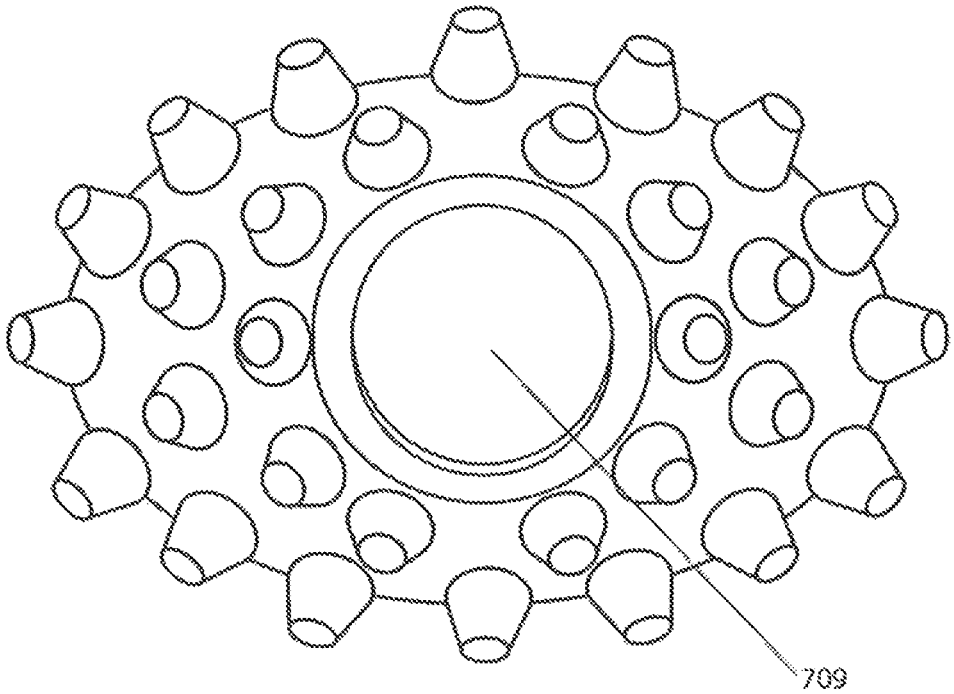
FIG. 8 illustrates the bottom side of the contemplated embodiment of the illuminating soap module in FIG. 7.

FIG. 8 is the same contemplated embodiment of FIG. 7, but the bottom view. The plug 709 is shown.

Figure 9:
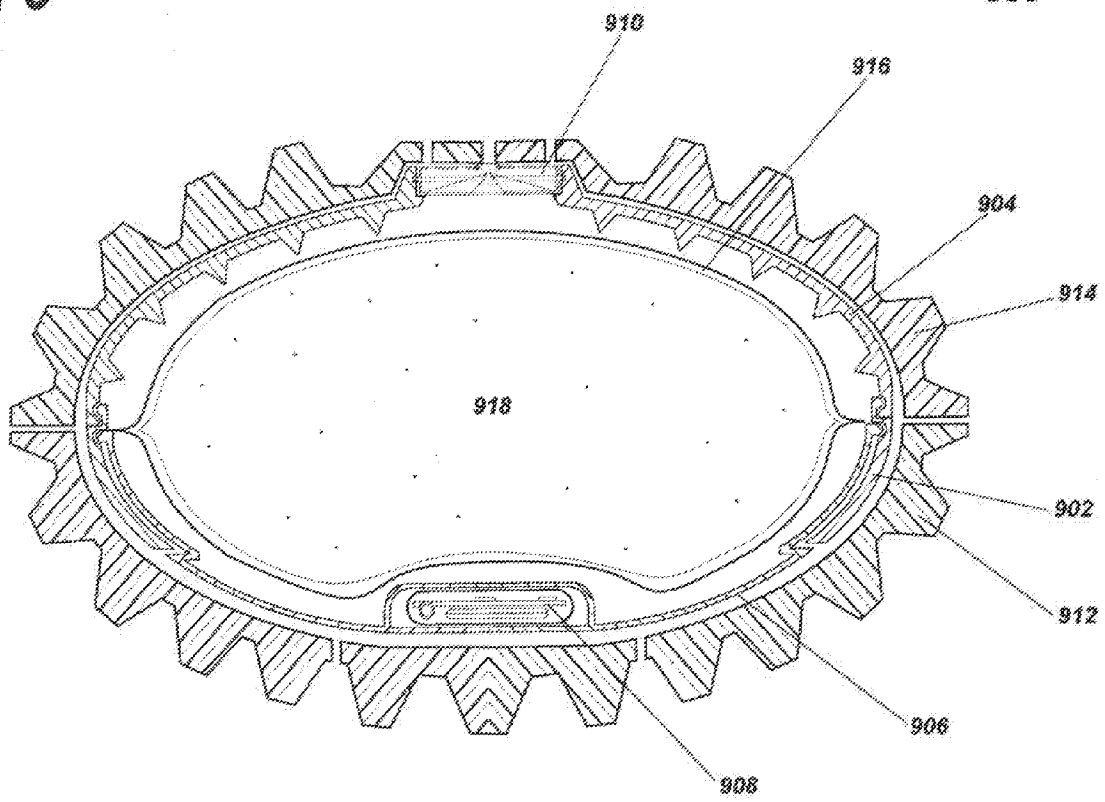
FIGS. 9-15B illustrate an exemplary embodiment of an illuminating soap module according to embodiments described herein.
Figure 10:
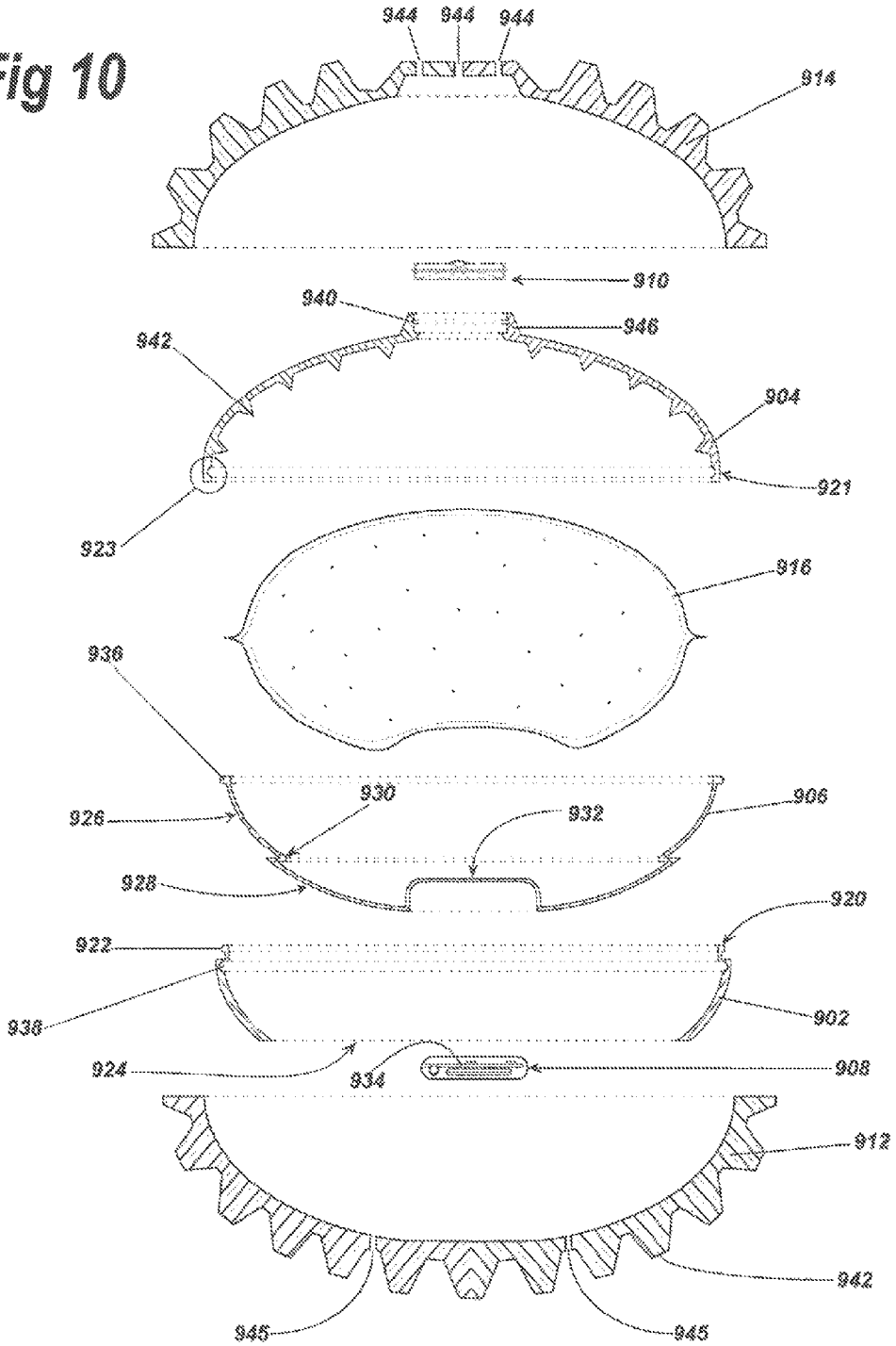
Figure 11:
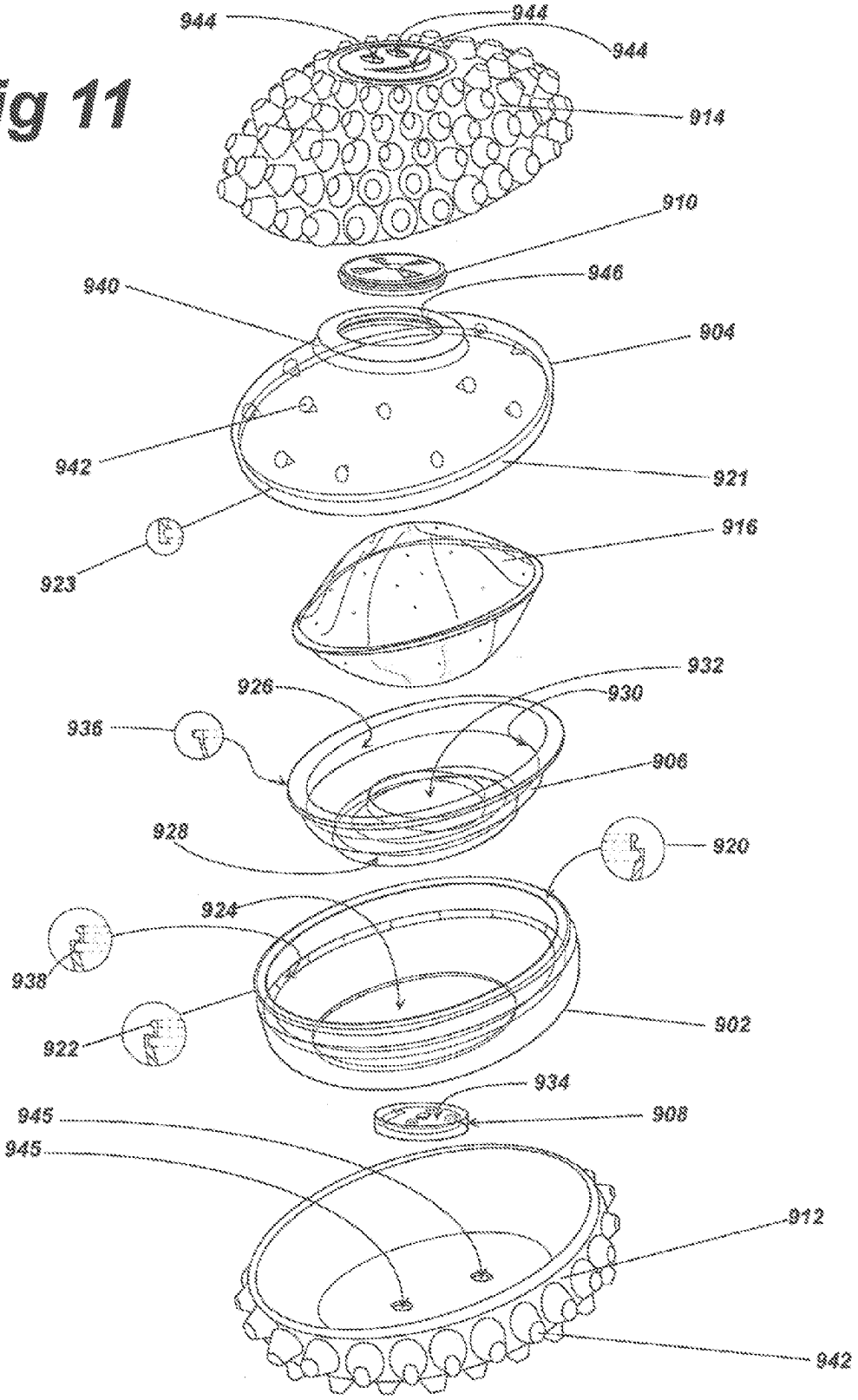
Figure 12:
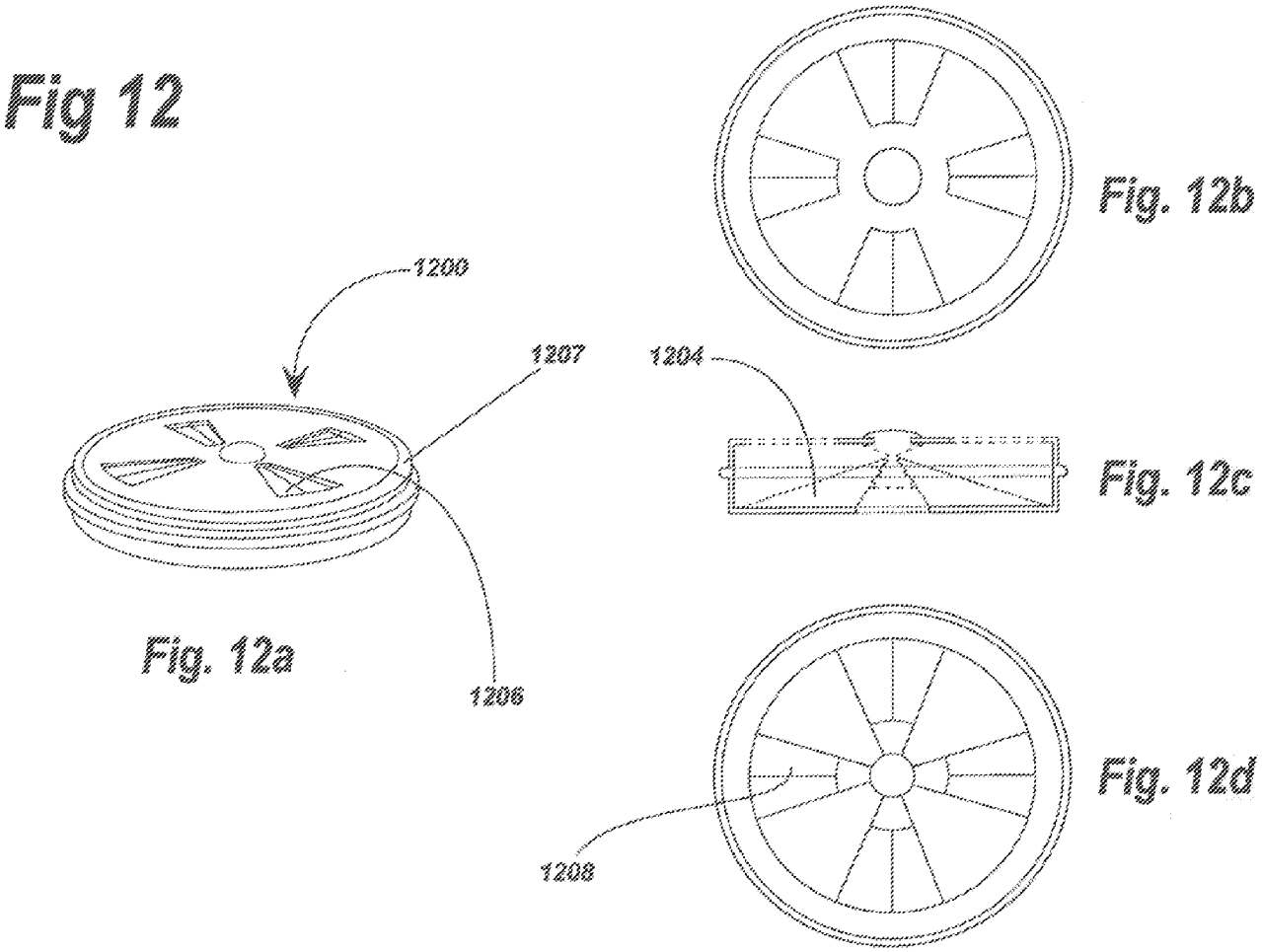
Figures 13, 13A, 13B, 13C, 13D:
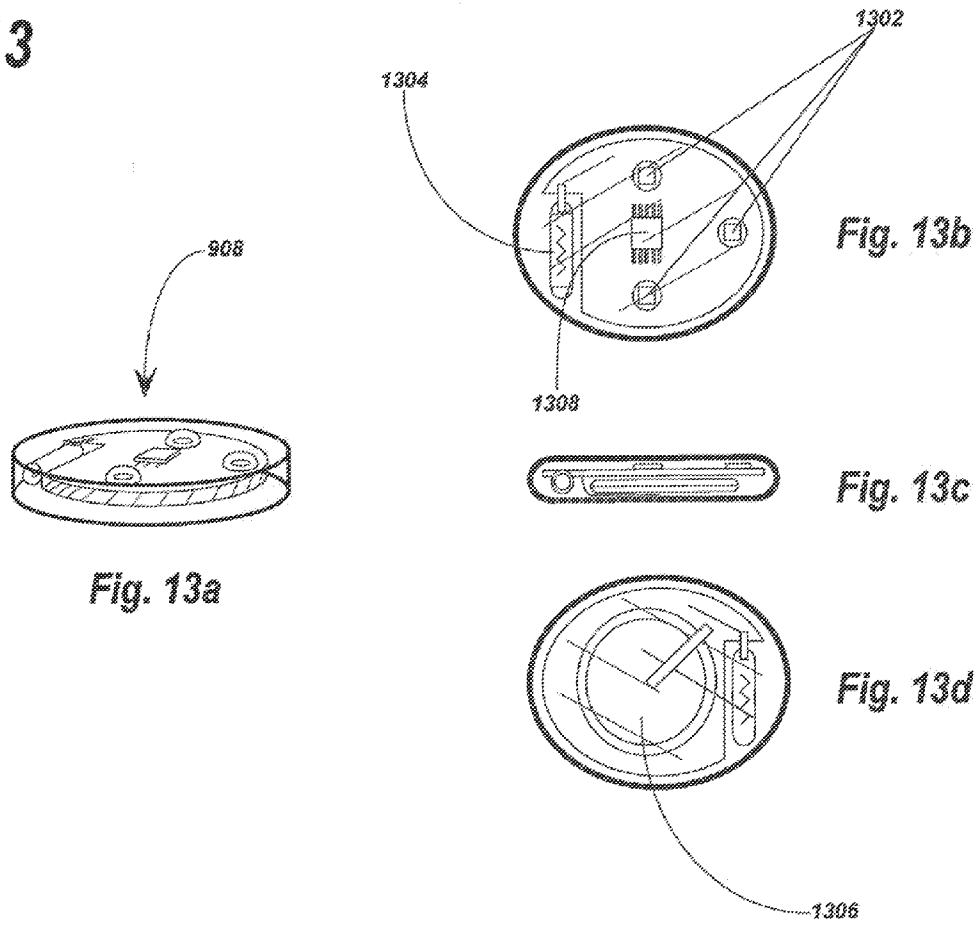

FIGS. 9-15 illustrate an exemplary embodiment of an illuminating soap module. The exemplary soap module 900 includes a light module 908 and a shell 902, 904 having a plug 906 and dispenser 910. FIG. 9 illustrates a cross sectional view of an exemplary illuminating soap module 900 in a closed configuration according to embodiments described herein. FIG. 10 illustrates a component separated cross section view of the exemplary illuminating soap module 900 in an open configuration. FIG. 11 illustrates an exploded component view of the exemplary illuminating soap module 900 according to embodiments described herein.

The illuminating soap module 900 includes a support structure to retain the components together and provide a structural framework for the module. As shown, a shell 902, 904 may be used to define a basic shape of the soap module. The shell 902, 904 may be a rigid or semi-rigid material to support and attach the respective components together. The shell 902, 904 may include a first side 902 and second side 904 that are removably attachable. For example, as best seen in the cut away exploded view of FIG. 10, the shell 902 may include a flange 920 that extends from the shell 902 to define a circumferential rim around an opening. The flange 920 may be flexible such that it translates inward when pressure is applied by shell 904. The flange 920 mates with a corresponding flange 921 extending from the shell 904 and defining a circumferential rim around a corresponding opening. The rims 920, 921 may create an interference fit such that one rim frictionally engages the other rim to retain the shell in a closed configuration. The rims 920, 921 may also include a detent/indent interface to improve the frictional engagement. As shown, rim 920 includes a radially outward projection 922 around a peripheral edge of the flange 920 that mates with a radially inward indention 923 on the flange 921 of shell 904. The indent/detent circumferentially surrounds the respective flange to improve the frictional engagement between shells. One or more indent/detent may be used in place of a continuous circumferential configuration. Other or alternative removable attachments may also be used.

In a closed configuration, the shell 902, 904 generally defines an ovoid-spherical shape. The shape may approximate a conventional bar of soap such that it is rectangular-cubic, or other geometry. As shown, the shape generally defines an oval in the horizontal plane and a rectangle or oval in the vertical plane. The corners may be curved between edges such that the resulting configuration is an approximation between an ovoid-rectangular form. The edges may be generally curved to facilitate washing and the size, shape, and configuration may be such to accommodate positioning and grasping by a user's hand. Therefore, the shell may define a major axis and minor axis. The length of the major axis may approximate the width of a human hand in a direction traversing the fingers. The minor axis may approximate the length between the base of the thumb to the base of the fingers or from the base of the thumb to the first knuckle of a finger from the palm. The length may be in reference to an adult hand, a child hand, or may be somewhere in between.

In the closed configuration, the shell 902, 904 may also define at least one opening. As shown, the shell 902, 904 in a closed configuration defines two openings on opposing sides of the shell—one opening 924, 940 on each portion or side of the shell, 902, 904, respectively. A first opening 924 supports the light module, while the second opening 940 supports a value or other dispenser to dispense the soap.

A first opening 924 in the first side of shell 902 supports plug 906. As shown, plug 906 has a first portion with an outer surface approximating an inner surface of shell 902. The first portion transitions to a second portion that traverses and closes the opening 924. The transition between the first portion and the second portion may be a straight, continuous extension such that first portion and second portion form a smooth continuous curved or straight surface. The transition between the first portion 926 and the second portion 928 may be step-wise. As shown, the first portion 926 defines a curved interior/exterior surface, and the section portion 928 defines a curved interior/exterior surface. The diameter of a terminal end of the first portion adjacent the second portion is less than the diameter of a terminal end of the second portion adjacent the first portion. As shown, the first portion 926 therefore tapers inwardly and then makes a step-wise outward projection 930 to start another inward taper of the second portion 928. The first portion 926 may extend across the entire interior surface of shell 920 such as from opening 927 to adjacent the flange 920 or only along a portion thereof. Second portion 928 may transition to an indentation 932 configured to accommodate light module 908. The indentation 932 may be circular cylindrical inward with an inner flat surface. Other indentation configurations may also be used to such that light module fits between plug 906 and covering 912.

Plug 906 may removably mate with shell 902. As shown, plug 906 is positioned adjacent an interior surface of shell 902. The terminal edge of plug 906 comprises a rim 936 that mates with indentation 938 on inner surface of shell 902. Indentation 938 may circumferentially surround an interior edge of an opening defined by shell 902. The indentation 938 may also be positioned adjacent flange 922. When the plug 906 is positioned in shell 902, the combination of rim 936 and stepwise projection 930 interacting with corresponding surfaces of shell 902 retain the plug 906 in position relative to shell 902 during use.

The plug may also include other configurations. For example, the plug may extend along an inner surface of both the first part of shell 902 and second part of shell 904. The plug may therefore substantially follow the inner contour of shell 902, 904. The plug may include an opening aligned with shell 904 opening. The plug may be formed in separate halves and attached together to provide a liquid impermeable membrane except for the opening. Exemplary embodiments of a plug may include a membrane extending across an opening of the shell. The membrane being liquid impermeable. The membrane may be larger than the opening such that it overlaps at least a circumferential edge of the shell opening. The membrane may extend along an interior surface of the shell. The membrane may correspond to approximately half of the shell (or approximately all of one side or part of the shell), the majority of the shell, or approximately all of the shell interior. In exemplary embodiments, the membrane covers and lines more than 40%, 40%-90%, approximately 50%, approximately 75%-90% of the interior shell surface. The membrane may be contoured to follow at least a portion of the interior surface of the shell. The membrane may include one or more surface features, contours, projections, indentations, and combinations thereof to mate with corresponding surface features on the interior surface of the shell to engage and retain the relative position of the membrane relative to the shell.

The plug is made of a flexible material. The plug may be a material more flexible than the shell material. The plug material generally may retain its shape when an outside force is not applied. However, the plug material may be easily deformable when an outside force is applied to the plug.

Light module 908 is described more fully herein with respect to FIGS. 3 and 13A-D, and elsewhere. As shown in FIG. 10, however, light module 908 may be encased or enclosed in enclosure 934. Covering 934 may fully enclose and seal the light module 908 such that it is water proof. The enclosure 934 may define an outer surface with a shape approximating the inner surface of indentation 932. The enclosure 934 may therefore frictionally mate with indentation 932 to retain the light module in place relative to the shell 902. The enclosure 934 may also adhere to the indentation or otherwise attach to the plug 906. The enclosure 934 may adhere because of the material selections between the plug and enclosure or with the addition of a bonding agent or through other treatment methods, such as thermal bonding. The enclosure 934 may also be smaller than indentation, such that the light module is free to move within the cavity defined between the plug 906 and covering 912.

FIGS. 13A-13D illustrate an exemplary embodiment of a light module 908. As shown, the light module may include one or more light sources 1302. As shown, three light sources are provided. The light sources may be of the same color or different colors. The light sources may be configured to provide solid illumination, color selected illumination, or strobed illumination, and combinations thereof. The light module 908 may include sensor 1304. Sensor 1304 may be used to detect a triggering condition such that the light module turns on the light when the trigging condition is experienced. Triggering conditions may include motion, temperature, pressure, and combinations thereof. For example, the sensor may be a button, an accelerometer, a thermocouple, and combinations thereof. The light module 1304 may also include a processor 1308 for controlling the light module. The processor 1308 may be configured to execute non-transitory, computer readable code stored on memory and retrieved by the processor. The code, when executed by the processor, may be configured such that the light module lights a select color upon detecting a specific temperature range, may light upon detection of motion, may light upon being turned on, may control a duration the light is on, and combinations thereof.

A second opening 940 in the second side of shell 904 supports dispenser 910. The second opening 940 may be defined by collar 946. Collar 946 may define a radial edge around the opening. The collar 946 may support and attach to dispenser 910. The attachment may be through frictional engagement. The frictional engagement may be enhanced by contouring interior surface of collar defining opening 940. The interior surface may include a flange to act as a stop for the dispenser. The interior surface may also include an indent/detent mated surface. The indent/detent may define an annular ring around the interior surface. Other configurations are also contemplated. For example, the interior surface may be threaded and the dispenser may be screwed into the shell.

FIGS. 12A-12D illustrate an exemplary embodiment of a dispenser. The dispenser may be a valve that opens and provides a liquid path from the shell interior to the shell exterior when depressed by a user. FIG. 12A illustrates a perspective view of an exemplary valve. FIG. 12B illustrates a top view, FIG. 12C illustrates a side view, and FIG. 12D illustrates a bottom view of an exemplary valve. As shown, an exemplary dispenser includes a valve 1200 having a valve housing 1202 enclosing a valve 1204. The valve housing includes holes 1206 on a top surface and holes 1208 on a bottom surface. The holes provide a liquid path through the valve housing when the valve is opened. The top surface of the valve includes a flexible material that may be depressed and translate inward toward the valve. When the top surface contacts the valve 1204, the valve opens. When the top surface is biased, such that when it is not depressed or experiencing an outside force, the top surface returns to its original condition away from the valve, such that the valve remains closed. An exemplary valve 1204 is similar to a duck-bill valve, however any valve configuration may be used that is opened when depressed.

Exemplary embodiments of the soap module 600 may also include an outer covering 912, 914. Outer coverings 912, 914 may be of a flexible material. The outer surface of coverings 912, 914 may include textured features. For example, the outer surface may include projections 942. Projections may be in different forms such as knobs, ridges, rings, and combinations thereof. The projections may include letters, words, shapes, and combinations thereof. The outer covering 912, 914 may include color changing or temperature sensitive materials. For example, the covering may include all or portions thereof that are a first color when under a temperature threshold and a second color when over a temperature threshold. The covering materials may indicate different temperature levels for washing. For example, the outer covering may be a first color for normal storage. The outer covering may turn a second color when at an appropriate temperature for washing was achieved. The outer covering may turn a third color when a safe temperature is exceeded. The outer material may be similar to the plug material in that it is flexible and deformable. The outer material may include one or more holes 944 on one or more sides to permit the liquid soap to traverse the covering material. The outer material may include one or more holes 945 on one or more sides to permit air to enter and release to allow the outer material to be flexible and deformable.

The soap module 900 encloses a replaceable soap packet 916. The soap packet 916 may include a flexible casing having liquid soap 918 in an interior thereof. The casing may be dissolvable such that once in use, the soap packet casing dissolves leaving the liquid soap on an interior thereof. The casing may also be punctured or opened when positioned in an interior of the soap module. The shell may include projections on an interior surface to puncture the liquid soap casing when the shell is positioned in the closed configuration. For example, as seen in FIG. 9, at least a portion of the interior surface of the shell includes a series of pointed inwardly directed projections. As shown, only one side of the shell 914 includes the inward projections 942. In this configuration, the plug is positioned along one side of the shell, and the inward projections are on another side opposite the one side of the shell such that the projections do not interfere with the plug. Liquid soap may also be directly poured into or through one or another of the openings of the shell.

Figure 15A:
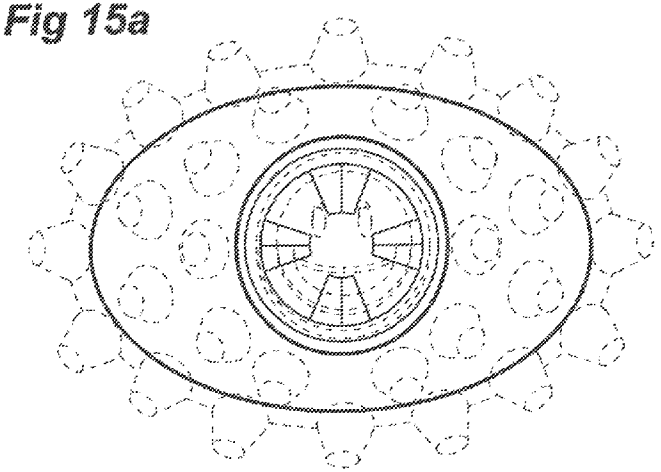
Figure 15B:
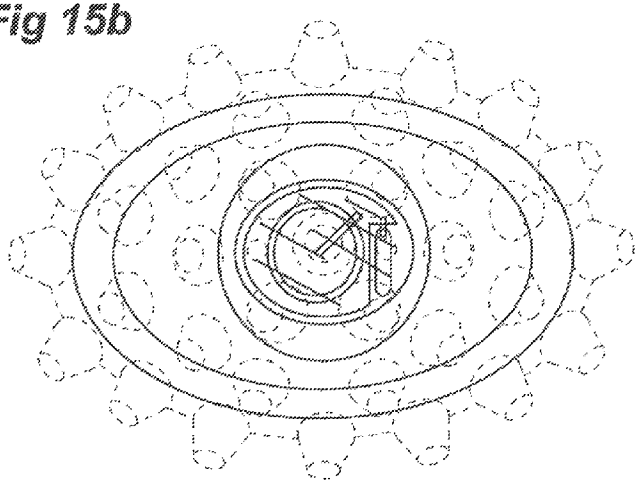
Figure 14A:
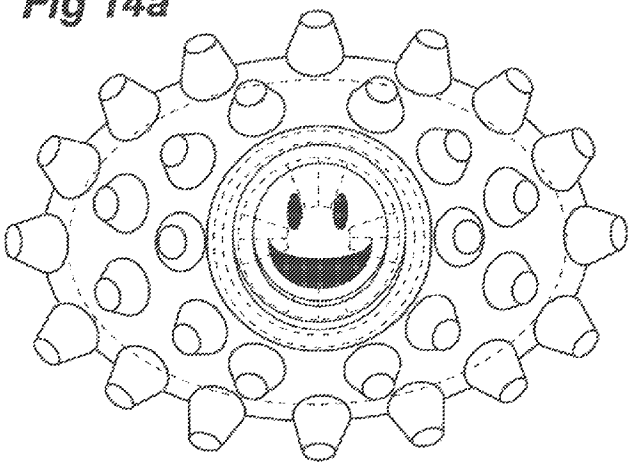
Figure 14B:
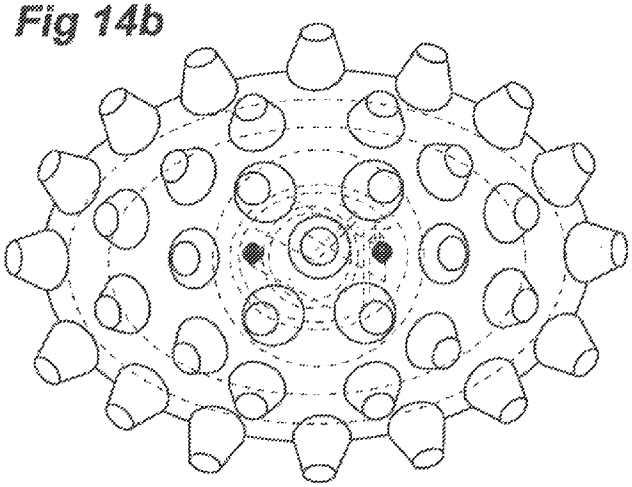

FIGS. 14A-14B illustrate an exemplary complete soap module according to exemplary embodiments described herein, from a top view and bottom view. FIGS. 15A-15B illustrate a top view and bottom view of the exemplary complete soap module with the outer covering in dashed lines to illustrate the underlying components including shell, dispenser, plug, and light module. As seen in FIGS. 14A-14B, the outer surface may be textured or otherwise decoratively adorned to facilitate scrubbing and/or enjoyment and attraction of the module. The outer covering may include holes to permit the liquid soap to be dispelled from the interior cavity of the module. The outer surface may also indicate the position to depress the covering in order to dispense soap. As shown, a smiley face is illustrated on the outer covering over the position of the valve. The covering may include holes, such as the eyes of the face to expel liquid soap when depressed.

Exemplary embodiments described herein are configured to illuminate upon use. The soap module may be configured to illuminate for a predefined duration to indicate a desired length to wash. The module may also illuminate as long as it is in continued use. The illumination may be started when the module is moved, when the light module is touched or depressed, when the module is within or above a certain temperature, and combinations thereof. The soap module may be configured to change colors when the module is at, above, or within a first temperature range. The soap module may be configured to be a second color when the module is at, below, within a second temperature range. Any number of temperatures and/or ranges may be used with any number of colors. Other indicators may also be used, such as different colors of a covering material, different colors of illumination, different patterns of illumination, different intensities of illumination, different sounds, or other indicators. If a sound is included, the light module may also include additional electronics to support the requisite need. The illuminated soap module may be configured to accept liquid soap or a liquid cleaning solution, however, it may also be configured to accept any type of liquid solution such as lotion, balms, toners, scrubs, washes and the like.

Thus, specific embodiments of an illuminated soap module have been disclosed. It should be apparent, however, to those skilled in the art that many more modifications besides those already described are possible without departing from the inventive concepts herein. Moreover, the exemplary embodiments are illustrative only. Components, features, and functions from one embodiment may be used within any other embodiment and remain within the scope of the present invention. Components may also be added, removed, duplicated, subdivided, substituted, integrated, or otherwise rearranged in any combination and remain within the scope of the instant application. The inventive subject matter, therefore, is not to be restricted except in the spirit of disclosure herein.

What is claimed is:

1. An illuminating soap module, comprising:

a shell defining a cavity, the shell having a first opening and a second opening;

a plug coupled to the shell sealing the first opening, the plug containing a light module;

a soap dispenser coupled to the shell and configured to selectively release a liquid soap contained in the shell through the second opening when the soap dispenser is compressed.

2. The illuminating soap module of claim 1, wherein the light module comprises at least one sensor and at least one light source that is triggered by the at least one sensor.

3. The illuminating soap module of claim 2, wherein the at least one sensor is a motion sensor.

4. The illuminating soap module of claim 2, wherein the at least one sensor is a button.

5. The illuminating soap module of claim 2, wherein the at least one light source is at least one light emitting diode powered by at least one battery.

6. The illuminating soap module of claim 2, wherein the at least one light source illuminates for a predetermined length of time.

7. The illuminating soap module of claim 1, wherein the shell comprises a first shell side removably attached to a second shell side.

8. The illuminating soap module of claim 7, wherein the plug is positioned adjacent an interior surface of the first shell side and covers the first opening in the first shell side.

9. The illuminating soap module of claim 7, wherein the dispenser comprises a housing and a valve within the housing, the housing positioned within the second opening.

10. The illuminating soap module of claim 1, wherein the plug is more flexible than the shell.

11. The illuminating soap module of claim 1, further comprises a covering having a textured outer surface.

12. The illuminating soap module of claim 11, wherein the covering is flexible.

13. The illuminating soap module of claim 1, wherein at least a portion of an interior surface of the shell includes projections configured to puncture a package containing liquid soap.

14. The illuminating soap module of claim 1, wherein the light module is configured to frictionally engage the plug.

15. The illuminating soap module of claim 14, wherein the light module is encased in a sealing material.

16. The illuminating soap module of claim 1, wherein the dispenser comprises a duck-bill valve.

17. A method of washing hands using an illuminating soap module, wherein the illuminating soap module comprises a shell with a first opening that contains a soap dispenser and a second opening that contains a plug, and a light module, the method comprising:

providing a soap module having a shell defining a cavity a light module having a sensor, and a dispenser configured to release liquid soap from the cavity when the dispenser is compressed;

compressing the dispenser to release the liquid soap;

triggering the sensor causing the light module to illuminate;

illuminating the light module; and washing the user's hands with the illuminating soap module, wherein the light module stops illuminating after a predetermined amount of time.

18. The method of claim 17, wherein the sensor is a motion sensor.

19. The method of claim 17, wherein the light module is coupled to the plug.

* * * * *